US005913098A

United States Patent [19]

Toyama

[11] Patent Number: 5,913,098

[45] Date of Patent: Jun. 15, 1999

[54] ELECTROPHOTOGRAPHING APPARATUS AND DEVELOPING AGENT EJECTING METHOD

[75] Inventor: Toshimasa Toyama, Kawasaki, Japan

[73] Assignee: Fujitsu Limited, Kanagawa, Japan

[21] Appl. No.: 08/870,288

[22] Filed: Jun. 6, 1997

[30] Foreign Application Priority Data

Dec. 19, 1996 [JP] Japan ..... 8-339211

[51] Int. Cl.[6] ..... G03G 15/08

[52] U.S. Cl. ..... 399/257

[58] Field of Search ..... 399/29, 257, 260

[56] References Cited

U.S. PATENT DOCUMENTS 5,307,123 4/1994 Aimoto ..... 399/257

5,355,199 10/1994 Bray ..... 399/257 X

*Primary Examiner*—William Royer

*Attorney, Agent, or Firm*—Armstrong, Westerman, Harroti, McLeland & Naughton

[57] ABSTRACT

An intermittent ejection processing unit detects a driving state of at least one of driving motors of a developing agent conveying member and a stirring member which are driven at a predetermined rotational speed when a developing agent is ejected and intermittently makes each driving motor operative until a detection value of the driving state decreases to a specified value, thereby intermittently ejecting the developing agent. A continuous ejection processing unit continuously makes each driving motor operative at a predetermined rotational speed after the detection value of the driving state of at least one of the driving motors was below the specified value, thereby continuously ejecting the developing agent, and finishes the ejection of the developing agent when the detection value of the motor driving state decreases to a specified value corresponding to a no-load state by the completion of the ejection of the developing agent.

10 Claims, 10 Drawing Sheets

ELECTROPHOTOGRAPHING APPARATUS AND DEVELOPING AGENT EJECTING METHOD

BACKGROUND OF THE INVENTION

The present invention relates to an electrophotographing apparatus and a developing agent ejecting method which are used in a printer, a copying machine, a facsimile, or the like to which an electrophotographing technique is applied. More particularly, the invention relates to an electrophotographing apparatus and a developing agent ejecting method for efficiently ejecting a used developing agent from a developing device which is used for supplying the developing agent to develop an electrostatic latent image on a photosensitive drum.

Hitherto, in such a kind of electrophotographing apparatus known as a laser printer, while a photosensitive drum is rotated, the surface is uniformly charged by a pre-charging device, a laser beam is exposed and scanned onto the surface of the drum, an electrostatic latent image of a pattern according to print information is formed, and the electrostatic latent image is developed by using a developing agent which is supplied by a developing device, thereby obtaining a toner image. On the other hand, a paper is fed from a hopper to a transfer position of the photosensitive drum and the toner image on the photosensitive drum is transferred onto the paper by a transfer charging device. After that, the toner on the paper is fixed by heat, pressure, light, or the like by a fixing device. As for the residual toner left on the photosensitive drum after the transfer, charges are eliminated by an AC discharging device and, after that, the residual toner is mechanically removed by a cleaning unit. Further, after executing an LED deelectrification for returning an electric potential on the photosensitive drum to an initial state (0V), the photosensitive drum surface is uniformly charged again by the pre-charging device and a subsequent printing process follows.

In such a conventional electrophotographing apparatus, a two-component developing agent constructed by a toner component consisting of fine powder particles of a coloring resin and a fine magnetic material carrier component is widely used. The developing device has: a stirring device for stirring the two-component developing agent in a container of the developing agent, thereby frictionally charging the toner component and the magnetic material carrier component; and a magnet roller for forming a magnetic brush by adsorbing a part of the magnetic material carrier by a magnetic force. The toner component is supplied from an exchangeable toner vessel. The magnet roller is exposed at a position of a developing region which faces the photosensitive drum. The toner component is electrostatically adhered to the head of the magnetic brush adsorbed and formed around the magnet roller and is conveyed to the developing region on the photosensitive drum, so that an electrostatic latent image is developed. A development concentration of the electrostatic latent image on the photosensitive drum in this case depends on an amount of toner which is conveyed to the developing region. In order to uniform the development concentration, a length of head of the developing agent which is formed as a magnetic brush onto the magnet roller is restricted by a doctor blade. The developing agent in which the toner component is reduced by the development is scraped from the magnet roller by a scraper and is returned to the stirring device side. The toner corresponding to a consumed amount is supplemented by the stirring device and the concentration is returned to a specified toner concentration. The toner is again used for development. When the toner component is consumed during the use and the specified toner concentration cannot be assured, a toner vessel is exchanged.

In the conventional electrophotographing apparatus, when a predetermined number of papers are printed, the developing agent in the developing device is replaced. This is because the magnetism of the magnetic carrier of the developing agent drops by an aging change and a printing ability deteriorates. This is called a developing agent life. In order to replace the developing agent, it is necessary to eject the used developing agent from the developing device. Generally, an ejecting port in the bottom plate of the developing device is opened, the magnet roller and a stirring screw are operated, and the developing agent in the developing device is completely ejected. In the case where the electrophotographing apparatus of this kind is used in a printing apparatus of a computer system, when the developing agent reaches the developing agent life during the operation of the system and a replacement of the developing agent is requested, since the developing agent is replaced in a state where the printing process is interrupted, it is requested to completely eject the developing agent in a short time. If the developing agent is not completely ejected in this instance, the developing agent in the developing device becomes too much after the replacement. A drive load of the developing device increases, so that the developing device cannot be driven or the developing agent overflows from the vessel. Further, when the toner concentration is controlled by using a magnetic permeability sensor, there is a problem such that the toner concentration is largely deviated from the specified value and is shifted to the high side, or the like. Consequently, in order to eject the developing agent completely, an ejecting work is certainly executed by taking a certain extent of time. In case of ejecting the developing agent by driving the magnet roller and stirring screw, for a predetermined period of time after the start of the ejection of the developing agent from the casing of the developing device, a large amount of developing agent is conveyed to a developing agent ejecting port by the stirring screw. When an amount of developing agent in the developing device decreases to a predetermined amount or less, the amount of developing agent is gradually reduced. In order to smoothly lead a large amount of developing agent for the predetermined period of time from the start of the ejection to a collecting vessel on the outside of the apparatus, a cross-sectional area of a minimum channel of a funnel provided at the ejecting port and a cross-sectional area of a channel of a hose have to be set to predetermined values or more, so that there is a certain limit when the apparatus is miniaturized. In recent years, not only the miniaturization of the apparatus but also the realization of an advanced function and a multi-function are strongly requested. With respect to a structure which is not usually used and is used for ejecting the developing agent, a miniaturization is also strongly requested, so that it is tried to use a small funnel and a small hose. If the small funnel is used, however, when a large amount of developing agent is dropped, the developing agent causes a bridge phenomenon and clogs in the funnel. When the hose is narrowed, the developing agent clogs in the hose. Consequently, a problem such that the developing agent overflows around the funnel into the apparatus occurs. In a printer, a copying machine, a facsimile, or the like, it is strongly requested to eject the developing agent at a high speed. In order to realize the high ejecting speed, rotational speeds of the magnet roller and the stirring screw are raised. However, since a large amount of developing agent is dropped to the funnel in association with an increase in speed, the developing agent clogs in the funnel and the hose and a problem of the overflow of the developing agent around the funnel into the apparatus occurs.

SUMMARY OF THE INVENTION

According to the invention, there is provided an electrophotographing apparatus in which the ejection driving of a developing agent conveying member and a stirring device of a developing device can be properly executed in accordance with an ejection state of a developing agent and the developing agent can be completely ejected in a short time.

It is an object of the invention to provide an electrophotographing apparatus comprising: a stirring member such as a stirring screw or the like for stirring a developing agent enclosed in a vessel; a developing agent conveying member such as a magnet roller or the like for adsorbing the developing agent and developing an electrostatic latent image on a photosensitive material, for example, a photosensitive drum; and a developing device having an ejecting port for ejecting the developing agent. According to the invention, an intermittent ejection processing unit and a continuous ejection processing unit are provided for such an electrophotographing apparatus. The intermittent ejection processing unit detects a driving state of at least one of driving motors of the developing agent conveying member and the stirring member which are driven at a predetermined rotational speed when the developing agent is ejected and intermittently operates each of the driving motors until a detection value of the driving state drops to a specified value, thereby intermittently ejecting the developing agent. After the detection value of the driving state of at least one of the driving motors is below the specified value, the continuous ejection processing unit continuously drives each of the driving motors at a predetermined rotational speed, thereby continuously ejecting the developing agent. Further, when the detection value of the motor driving state decreases to the specified value corresponding to a no-load state by completion of the ejection of the developing agent, the continuous ejection processing unit finishes the ejection of the developing agent. The intermittent ejection processing unit and the continuous ejection processing unit detect a motor drive current or a motor drive torque as a driving state of at least one of the driving motors. Since the ejecting state of the developing agent is recognized from the driving state such as current or torque of the motor which is driven at the time of ejection and the operating mode is switched from the intermittent operation to the continuous operation, the optimum switching operation can be performed in accordance with fluctuation factors such as amount of developing agent to be actually ejected, toner concentration, lot difference, deterioration state according to printing conditions, apparatus environment such as a temperature or the like, and the like. Since the end of the ejection is also determined by the drive current or the drive torque corresponding to the no-load state, a situation such that the developing agent is not completely ejected or the operation is executed for a longer time than it is needed after completion of the ejection is prevented and the developing agent can be completely ejected in a short time.

Another embodiment of the invention is characterized in that an intermittent ejection processing unit is used as a continuous ejection processing unit and after a detection value of a driving state of at least one of driving motors was below a specified value, the intermittent ejection processing unit continuously ejects a developing agent by a continuous operation in which a drive current of each driving motor is fixed to a predetermined value, and a rotational speed is detected, and when the rotational speed increases to a specified rotational speed corresponding to a no-load state by the completion of the ejection of the developing agent, the intermittent ejection processing unit finishes the ejection of the developing agent. In this case, the intermittent ejection processing unit detects a motor drive current or a motor drive torque as a driving state of at least one of the driving motors.

According to the invention, a developing agent ejecting method of an electrophotographing apparatus is also provided. The developing agent ejecting method comprises: an intermittent ejecting step of detecting a driving state of at least one of driving motors of a developing agent conveying member and a stirring member which are driven at a predetermined rotational speed when a developing agent is ejected and, intermittently operating each of the driving motors until a detection value of the driving state decreases to a specified value, thereby intermittently ejecting the developing agent; a continuous ejecting step of continuously operating each of the driving motors at a predetermined rotational speed after the detection value of the driving state of each of the driving motors in the intermittent operation was below the specified value, thereby continuously ejecting the developing agent; and an ejection finishing step of finishing the ejection of the developing agent when the detection value of the motor driving state decreases to the specified value corresponding to a no-load state by the completion of the ejection of the developing agent in the continuous ejecting step.

According to another embodiment of the invention, there is provided a developing agent ejecting method comprising: an intermittent ejecting step of detecting a driving state of at least one of driving motors of a developing agent conveying member and a stirring member which are driven at a predetermined rotational speed when a developing agent is ejected and intermittently operating each of the driving motors until a detection value of the driving state decreases to a specified value, thereby intermittently ejecting the developing agent; a continuous ejecting step of continuously ejecting the developing agent by a continuous operation in which a drive current of each of the driving motors is fixed to a predetermined value after the detection value of the driving state of any one of the driving motors was below the specified value; and an ejection finishing step of finishing the ejection of the developing agent when a rotational speed of at least one of the driving motors increases to a specified rotational speed corresponding to a no-load state by the completion of the ejection of the developing agent in the continuous ejecting step.

The above and other objects, features, and advantages of the present invention will become more apparent from the following detailed description with reference to the drawings.

DETAILED DESCRIPTION OF THE PREFERRED EMBODIMENTS

Figure 1:
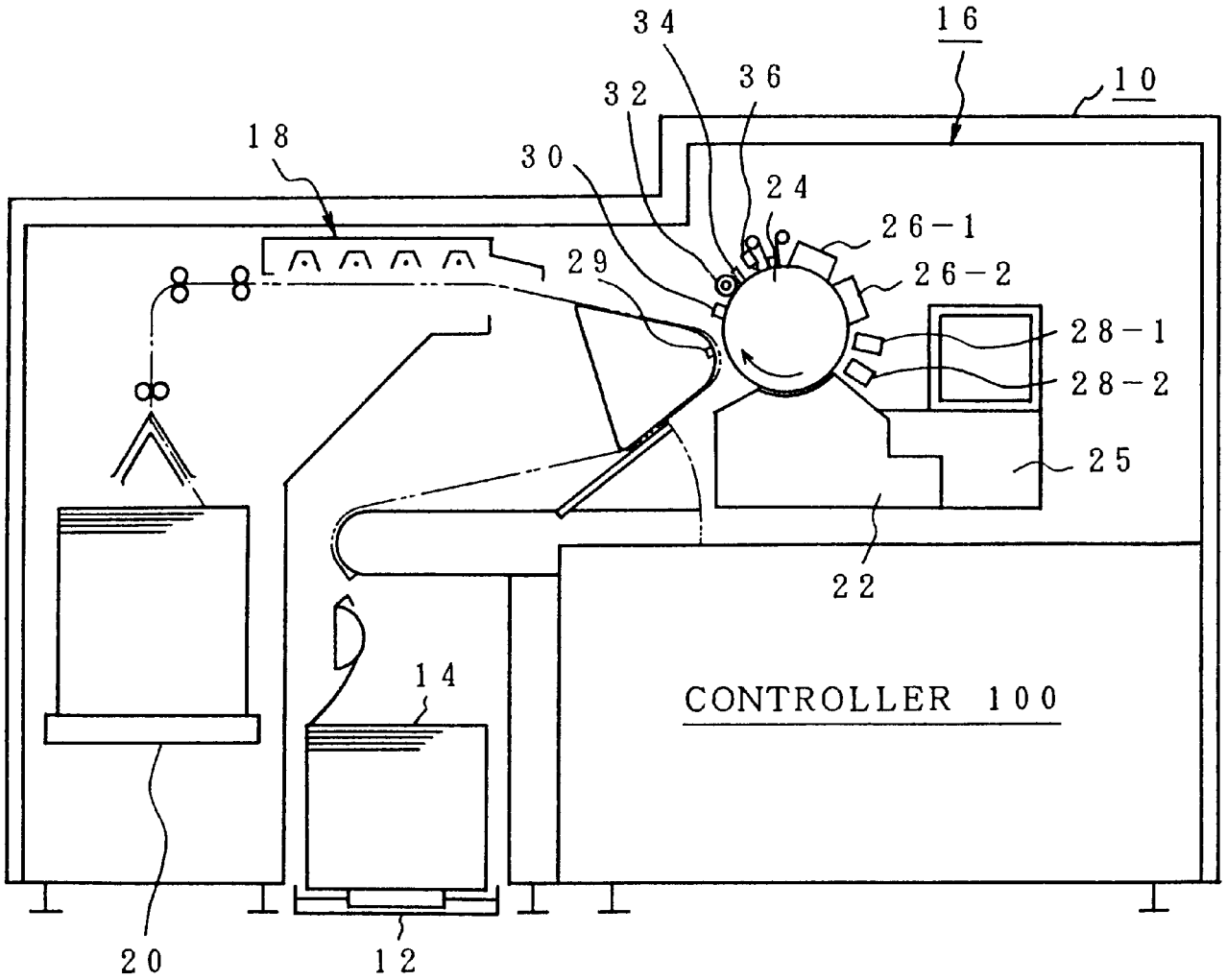
FIG. 1 is an explanatory diagram of a page printer to which the invention is applied.

FIG. 1 shows an embodiment of an electrophotographing apparatus to which the invention is applied, in which a page printer 10 is shown as an example. In the page printer 10, continuous papers 14 are enclosed in a hopper 12. The continuous paper 14 pulled from the hopper 12 is led to an electrophotograph printing mechanism of an image forming unit 16 having a developing device 22 and a photosensitive drum 24 and a toner image is transferred. The transferred image is fixed onto the continuous paper 14 by a fixing device 18. The continuous paper 14 is folded and stacked in a stacker 20. In the image forming unit 16, the surface of the photosensitive drum 24 is uniformly charged by charging devices 26-1 and 26-2 arranged around the photosensitive drum 24 which rotates at a predetermined speed and is exposed by a light emission driving according to print information of LED print heads 28-1 and 28-2, thereby forming an electrostatic latent image onto the surface of the photosensitive drum 24. A toner image is developed by the developing device 22 for the electrostatic latent image formed on the photosensitive drum 24 and the toner image is transferred onto the continuous paper 14 by a transfer charging device 29. After transferring the toner image, the surface of the photosensitive drum 24 is discharged by a discharging and charging device 30. After that, residual toner is removed from the surface of the photosensitive drum 24 by a cleaning brush 32 and a cleaning blade 34, After the surface of the photosensitive drum 24 was finally uniformly discharged by an irradiation of a light by a deelectrifying LED 36, the processes from the initial charging by the charging devices 26-1 and 26-2 are repeated. The developing device 22 for developing the electrostatic latent image formed on the surface of the photosensitive drum 24 has a toner hopper 25.

Figure 2:
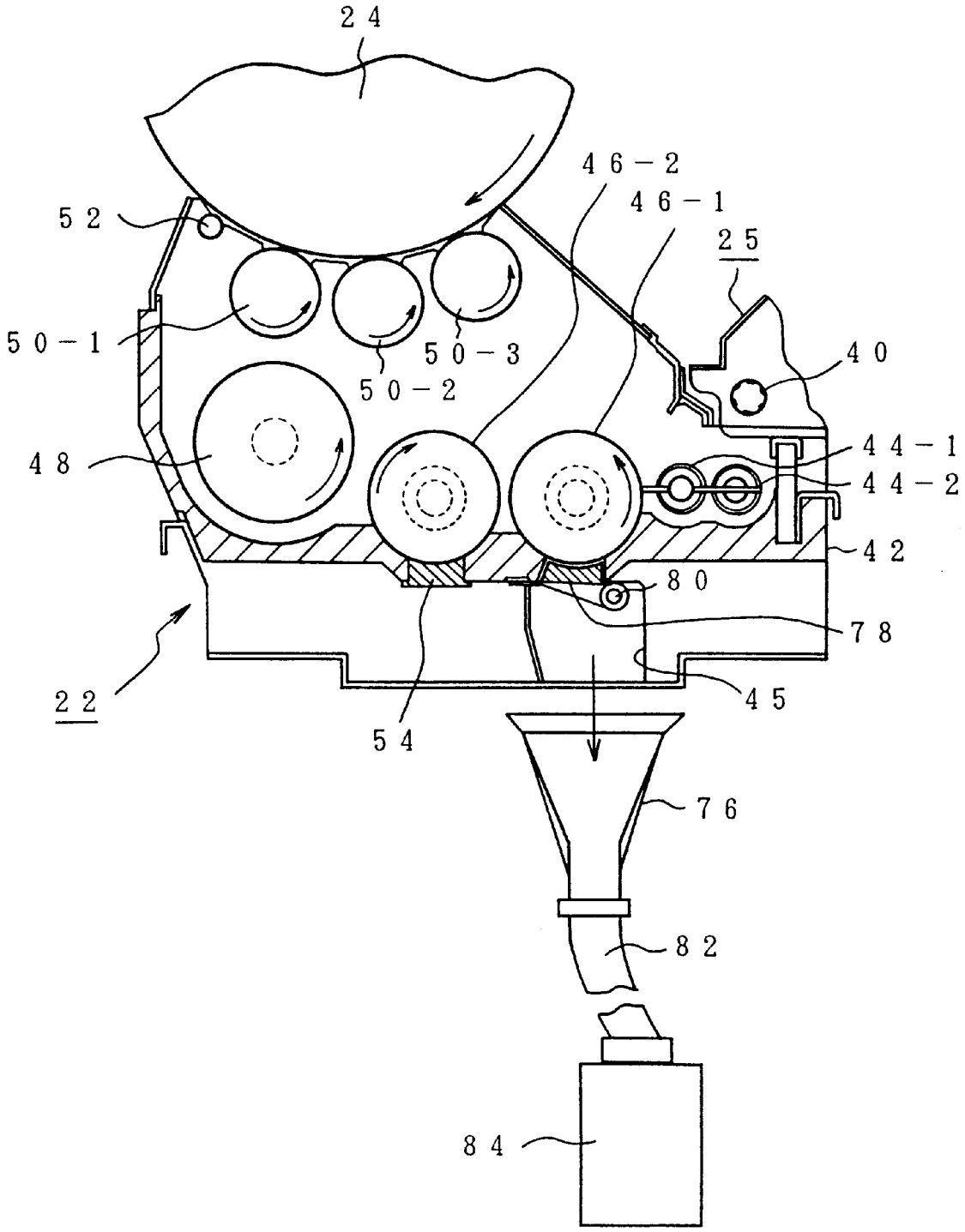
FIG. 2 is an explanatory diagram of a construction of a developing device in FIG. 1.
Figure 3:
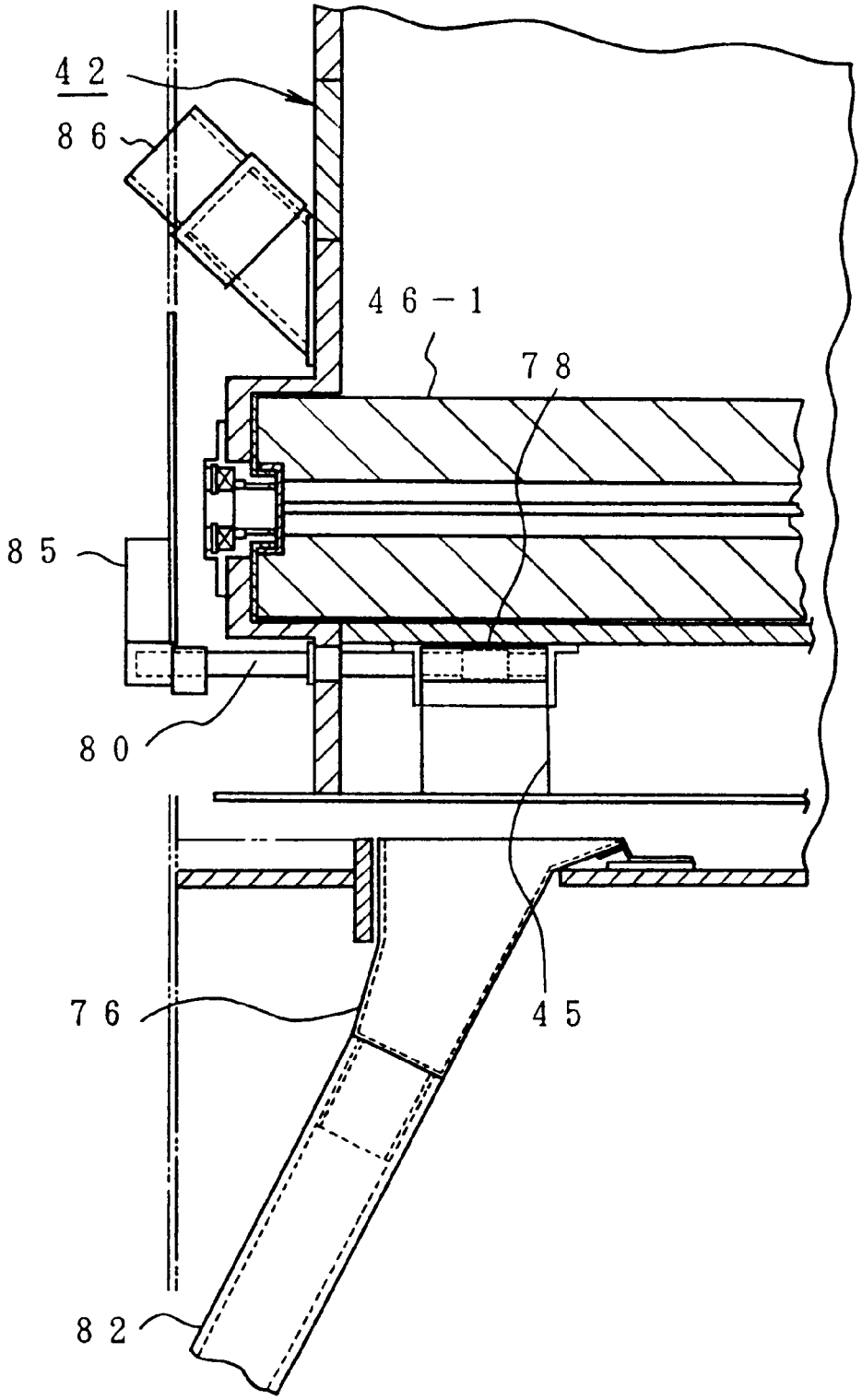
FIG. 3 is an explanatory diagram of an ejection port opening/closing structure of the developing device in FIG. 2.

FIG. 2 shows a detailed construction of the developing device 22 in FIG. 1. A two-component developing agent comprising a toner component consisting of fine powder particles of a color resin and a fine magnetic material carrier component is enclosed in a developing device casing 42 of the developing device 22. The toner component in the two-component developing agent has a mean diameter of, for example, 10 $\mu$m and the magnetic material carrier has a mean diameter of 80 $\mu$m. The toner for the developing device casing 42 is supplied from the toner hopper 25. The toner hopper 25 has therein a toner supply roller 40. When a detection value of a toner concentration sensor (magnetic permeability sensor) 54 provided in the developing device casing 42 is equal to or less than a specified value, by driving the toner supply roller 40 at a specified rotational speed for a specified time, a predetermined amount (for example, 0.5 g) of toner is supplemented at a time. The toner supplied from the toner hopper 25 to the developing device casing 42 is sent to a first stirring screw 46-1 by two conveying paddles 44-1 and 44-2 and is sent in the axial direction while being stirred with the developing agent in the casing by the first stirring screw 46-1. The toner is sent back from a feeding end of an axial edge portion to a second stirring screw 46-2. The second stirring screw 46-2 is rotated clockwise which is opposite to the counterclockwise rotating direction of the first stirring screw 46-1. Consequently, the developing agent fed from the first stirring screw 46-1 side is sent in the axial direction as a reverse direction by the second stirring screw 46-2. The two-component developing agent is circulated in the developing device casing 42 by the first stirring screw 46-1 and second stirring screw 46-2 and the toner component and the magnetic material carrier component are mutually frictionally charged by stirring. In the two-component developing agent circulated by the first stirring screw 46-1 and second stirring screw 46-2, the magnetic material carrier is adhered around a conveyer roller 48 using a magnet roller, thereby forming a magnetic brush. The toner component is electrostatically adhered to the head of the magnetic brush and is supplied to three developing magnet rollers arranged around the upper photosensitive drum 24. In a manner similar to the conveyor roller 48, developing magnet rollers 50-1 to 50-3 adsorb the magnetic material carriers around the rollers and form magnetic brushes. The toner component from the conveyor roller 48 is electrostatically adsorbed to the head of each of the magnetic brushes. The developing magnet rollers 50-1 to 50-3 rotate counterclockwise. On the other hand, the photosensitive drum 24 rotates clockwise. For example, the photosensitive drum 24 has a diameter of 80 mm and rotates clockwise at a peripheral velocity of 200 mm/sec. Each of the developing magnet rollers 50-1 to 50-3 of the developing device 22 has, for example, a diameter of 50 mm and rotates counterclockwise at a peripheral velocity of 400 mm/sec. The developing magnet rollers 50-1 to 50-3 provided for the developing device 22 are disposed, for example, with intervals of 2 mm for the developing region of the photosensitive drum 24. The developing magnet rollers 50-1 to 50-3 adsorb the magnetic material carriers and form magnetic brushes. The toner component conveyed by the conveyor roller 48 is electrostatically adhered to the head of each magnetic brush. The toner component is conveyed to the developing region of the photosensitive drum and the electrostatic latent image is developed, thereby forming a toner image. A length of head of the developing agent of the magnetic brush formed on each of the developing magnet rollers 50-1 to 50-3 is restricted by a doctor blade (not shown), thereby uniforming a development concentration. When a predetermined specified number of papers were printed and a life of the developing agent enclosed in the developing device 22 reaches a developing agent life, a lid 78 provided on the bottom of the developing device casing 42 is opened by being rotated downward around an axis 80 as a center. A collecting bottle 84 is connected to a funnel 76 by a hose 82 and the developing agent in the developing device 22 is ejected. As for an opening operation of the lid 78 provided at a developing agent ejecting port 45, as shown in FIG. 3, the end of the axis 80 is projected to the outside of the developing device casing 42 and a developing agent ejection lever 85 is provided at the end. By rotating the developing agent ejection lever 85, the lid 78 is opened and the developing agent can be ejected. When the developing agent is ejected from the developing device 22, in the invention, an ejection control of two stages of an intermittent rotation and a continuous rotation of the conveying paddles 44-1 and 44-2, first and second stirring screws 46-1 and 46-2, conveyor roller 48, and further, developing magnet rollers 50-1 to 50-3 is executed.

Figure 4:
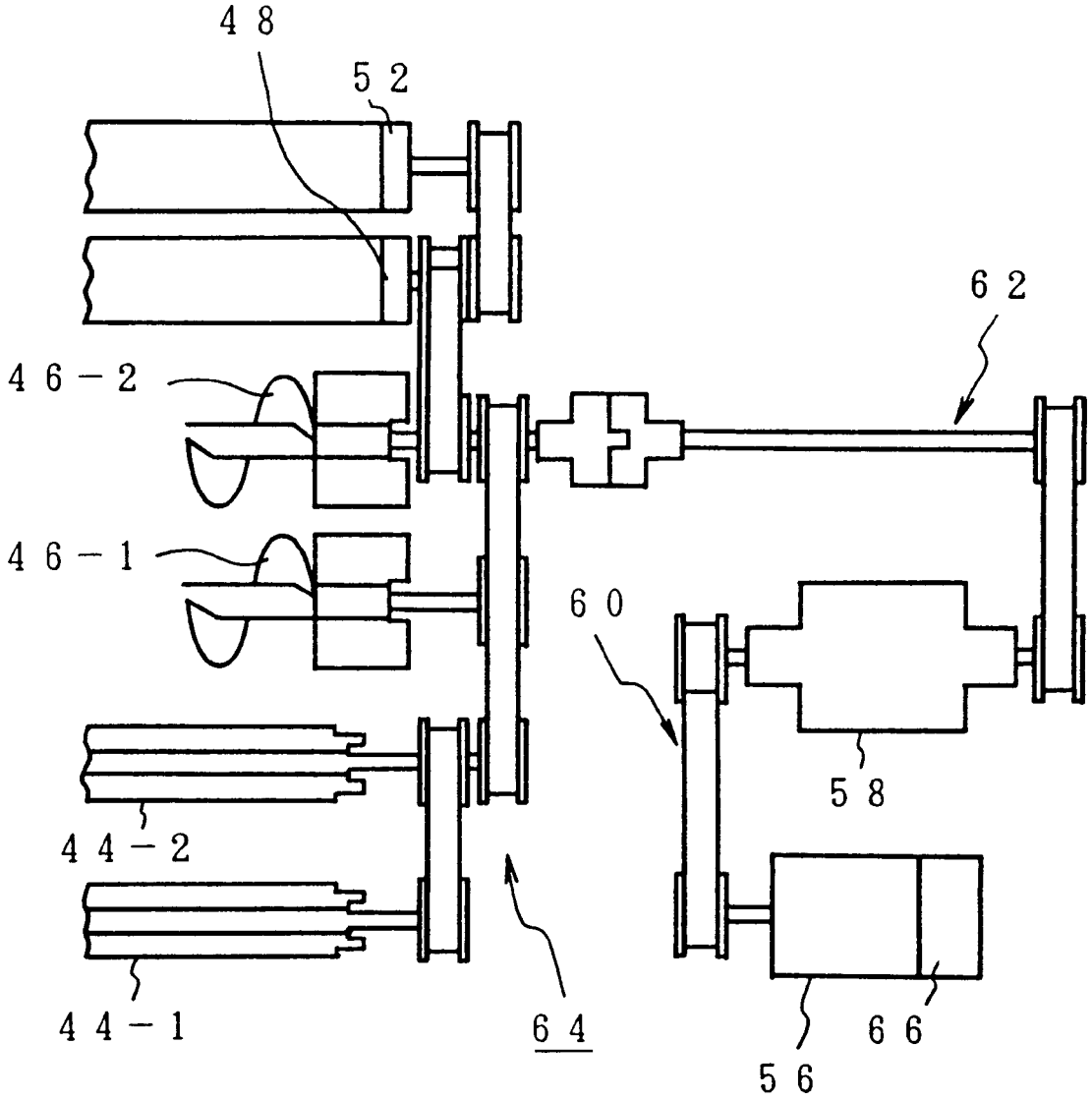
FIG. 4 is an explanatory diagram of a driving mechanism for driving a stirring screw side in FIG. 2.

FIG. 4 shows a driving mechanism of the conveying paddles 44-1 and 44-2, first and second stirring screws 46-1 and 46-2, conveyor roller 48, and a collecting magnet roller 52 which are provided in the developing device 22 in FIG. 2. In the driving mechanism, a rotation of a stirring motor 56 is transferred to a reduction gear 58 by a belt transfer mechanism 60, an output rotation reduced by the reduction gear 58 is transferred to a belt transfer mechanism 64 by a transfer mechanism 62, and the conveying paddles 44-1 and 44-2, first and second stirring screws 46-1 and 46-2, conveyor roller 48, and further, collecting magnet roller 52 are interlockingly rotated. Further, in the invention, a rotation detector 66 for detecting a motor rotational speed is provided for the stirring motor 56.

Figure 5:
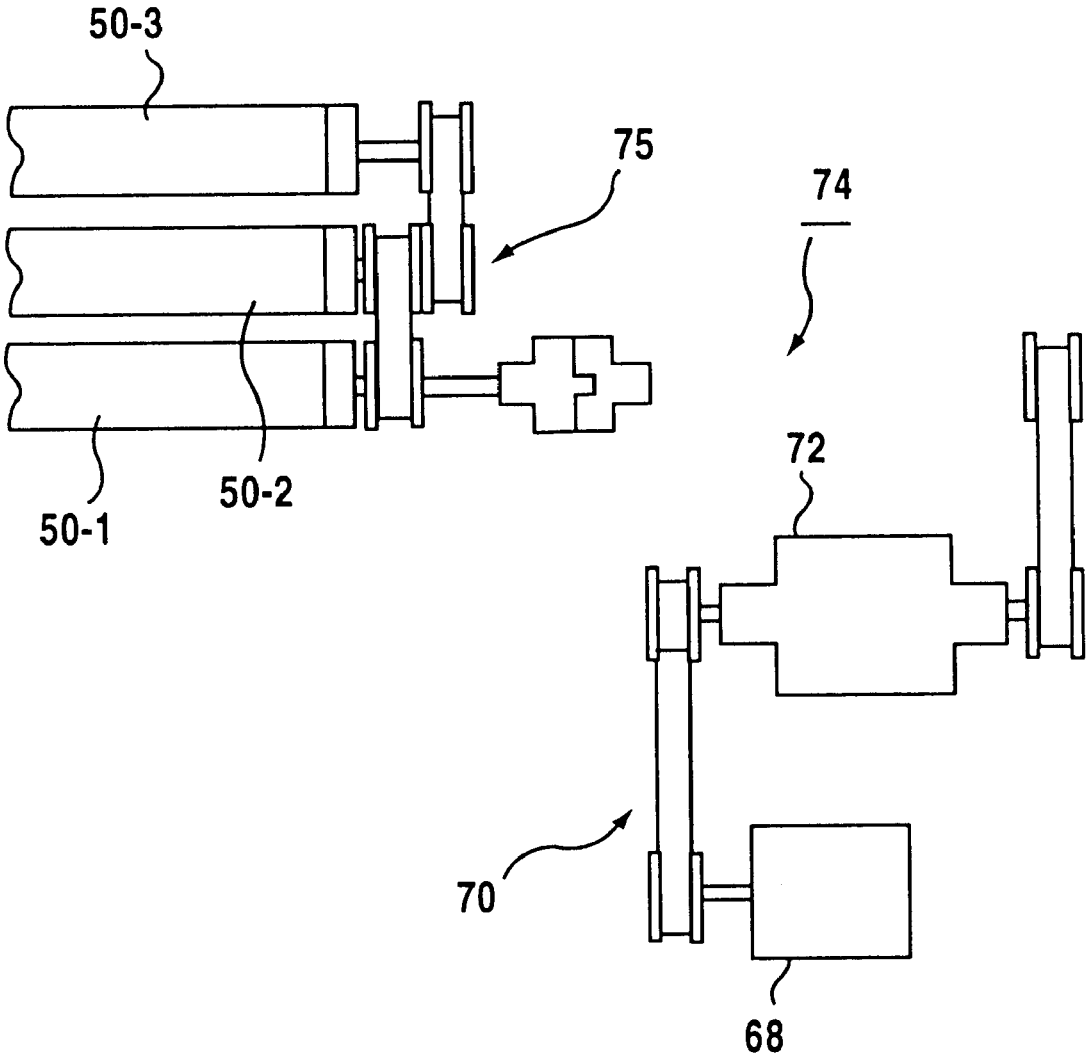
FIG. 5 is an explanatory diagram of a driving mechanism of a developing magnet roller in FIG. 2.

FIG. 5 shows a driving mechanism of the developing magnet rollers 50-1 to 50-3 provided in the developing device 22 in FIG. 2. In the driving mechanism, a rotation of a developing motor 68 is transferred to a reduction gear 72 by a belt transfer mechanism 70 and is reduced and an output rotation reduced by the reduction gear 72 is transferred to a belt transfer mechanism 75 by a transfer mechanism 74, thereby interlockingly rotating the three developing magnet rollers 50-1 to 50-3.

Figure 6:
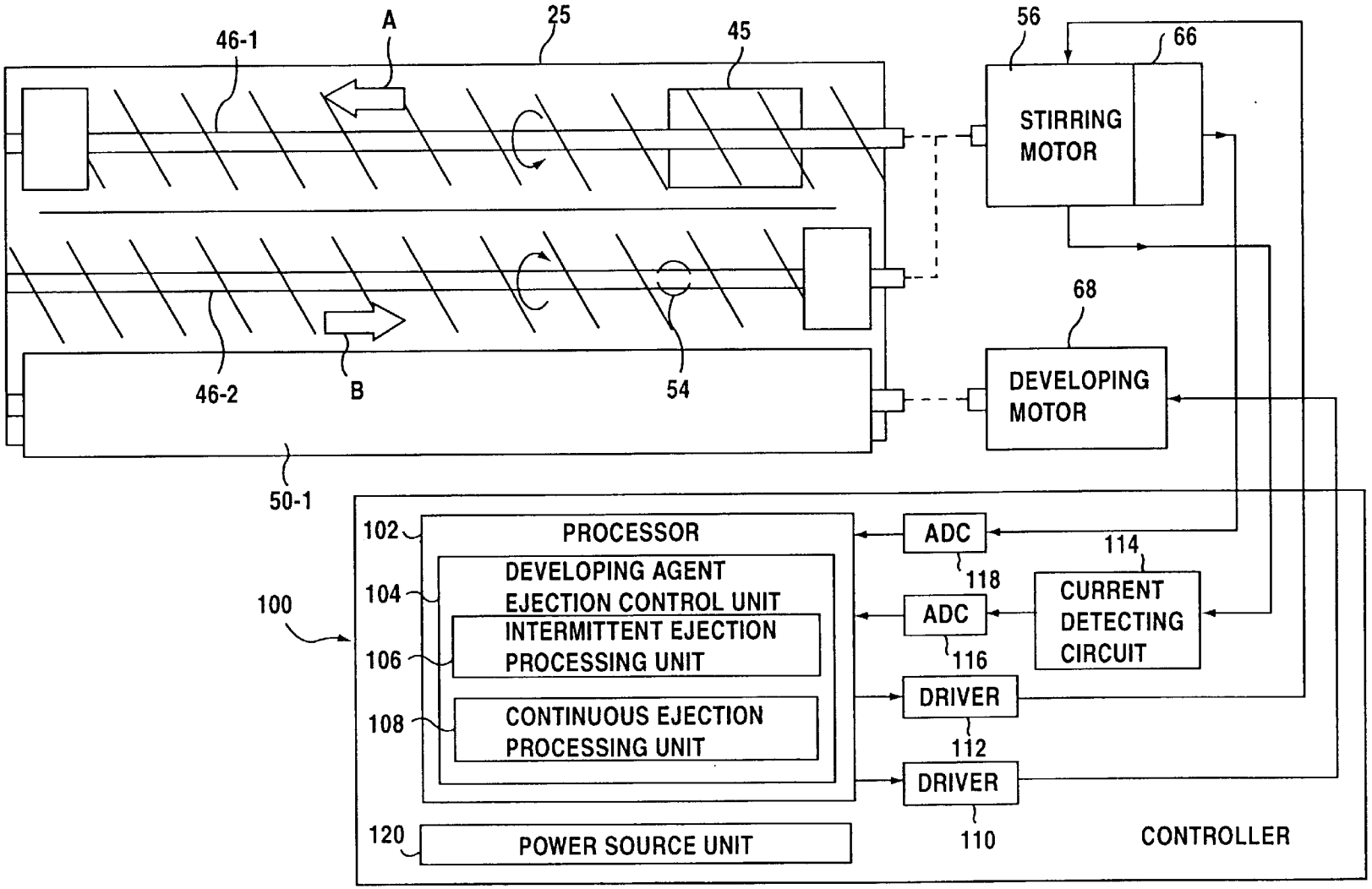
FIG. 6 is a functional block diagram showing an embodiment of a developing agent ejection control of the invention together with an internal construction of the developing device.

FIG. 6 is a functional block diagram for a developing agent ejection control in the electrophotographing apparatus of the invention and such a control is realized as a control function of a controller 100 provided in the page printer 10 of FIG. 1. Further, a schematic plan view of the portions of the first and second stirring screws 46-1 and 46-2 and developing magnet roller 50-1 which are provided in the developing device 22 in FIG. 2 is together shown. The stirring motor 56 and developing motor 68 for driving them are also shown. With respect to the first and second stirring screws 46-1 and 46-2 provided in the developing device 22, for example, the first stirring screw 46-1 is rotated counterclockwise when it is seen from the stirring motor 56 and the second stirring screw 46-2 is rotated clockwise as a reverse direction, so that the developing agent enclosed in the developing device 22 is circulated therein as shown by arrows A and B. A processor 102 is provided for the controller 100 and a developing agent ejection control unit 104 is also provided as a control function of the processor 102. The processor 102 has hardware such as CPU, ROM, and the like. The developing agent ejection control unit 104 of the processor 102 has functions of an intermittent ejection processing unit 106 and a continuous ejection processing unit 108 in order to execute the developing agent ejection control of the invention. Drivers 110 and 112, A/D converters 116 and 118, and further, a current detecting circuit 114 are provided for input/output units of the processor 102. The driver 110 drives the developing motor 68 in the developing device 22. The driver 112 drives the stirring motor 56 in the developing device 22. The current detecting circuit 114 detects a drive current of the stirring motor 56 in the developing device 22. The drive current of the stirring motor 56 detected by the current detecting circuit 114 is converted to digital data by the A/D converter 116 and is inputted to the processor 102. In order to realize another embodiment of the invention, the rotation detector 66 is further provided for the stirring motor 56. The rotational speed of the stirring motor 56 detected by the rotation detector 66 is converted to digital data by the A/D converter 118 and is inputted to the processor 102. The intermittent ejection processing unit 106 provided for the developing agent ejection control unit 104 detects the drive current of the stirring motor 56 which is driven at a predetermined rotational speed when the developing agent is ejected and continuously operates the stirring motor 56 and developing motor 68 at a predetermined on/off period until the drive current decreases to a predetermined specified value, thereby intermittently ejecting the developing agent. The continuous ejection processing unit 108 continuously operates the stirring motor 56 and developing motor 68 at a predetermined rotational speed, thereby continuously ejecting the developing agent. The developing agent ejecting operation is finished when the motor drive current decreases to a predetermined specified value corresponding to a no-load state indicative of the completion of the ejection of the developing agent. Further, a power source unit 120 is provided for the controller 100, thereby supplying a power source to the respective units.

An ejecting process by the developing agent ejection control unit 104 in FIG. 6 will now be described with reference to a flowchart of FIG. 7. When the developing agent reaches the developing agent life during the operation of the electrophotographing apparatus, for example, the page printer of FIG. 1, a code number or a message indicative of a request to exchange the developing agent is outputted to an operation display panel or the like. Upon receipt of the developing agent exchange request, as shown in FIGS. 2 and 3, the operator connects the collecting bottle 84 to the funnel 76 provided in the bottom portion of the developing device casing 42 by the hose 82 and, subsequently, operates the developing agent ejection lever 85 provided in the front portion of the developing device casing 42 and opens the lid 78 of the developing agent ejection port 45 in step S1, thereby preparing for ejection of the developing agent. When the preparation for ejection of the developing agent is finished, the operator activates the developing agent ejection control by operating the operation panel or the like. When the developing agent ejection control is started, in step S2, the developing agent ejection control unit 104 drives the stirring motor 56 and developing motor 68 by the drivers 110 and 112, thereby making the developing magnet rollers 50-1 to 50-3, first and second stirring screws 46-1 and 46-2, magnet roller 48, and conveying paddles 44-1 and 44-2 operative at a predetermined rotational speed R=R0 for a predetermined time T1, for example, T1=2 seconds. During the operation for time T1, a drive current I1 of the stirring motor 56 is measured in step S3 and is compared with a predetermined specified value Ith in step S4. When the measured drive current I1 is equal to or larger than the specified value Ith, the processing routine advances to step S5 and the operations of the stirring motor 56 and developing motor 68 are stopped for a predetermined time T2, for example, T2=1 second. The processing routine is returned to step S2 and the motor rotation for the predetermined time T1 is repeated. For a period of time during which the drive current I1 of the stirring motor 56 is equal to or larger than the specified value Ith, therefore, the stirring motor 56 and developing motor 68 repeat an intermittent rotation such that they operate for T1=2 seconds and stop for T2=1 second. Consequently, the developing agent is ejected by the intermittent rotation of the first and second stirring screws 46-1 and 46-2 and developing magnet rollers 50-1 to 50-3. At the initial stage of the ejection of the developing agent, since the ejection amount of the developing agent from the ejecting port 45 is large, a clogging is likely to occur. However, the clogging of the developing agent at the ejecting port 45 is prevented by the intermittent rotation, so that even in a state of a large amount of developing agent, the developing agent can be efficiently ejected.

Figure 7:
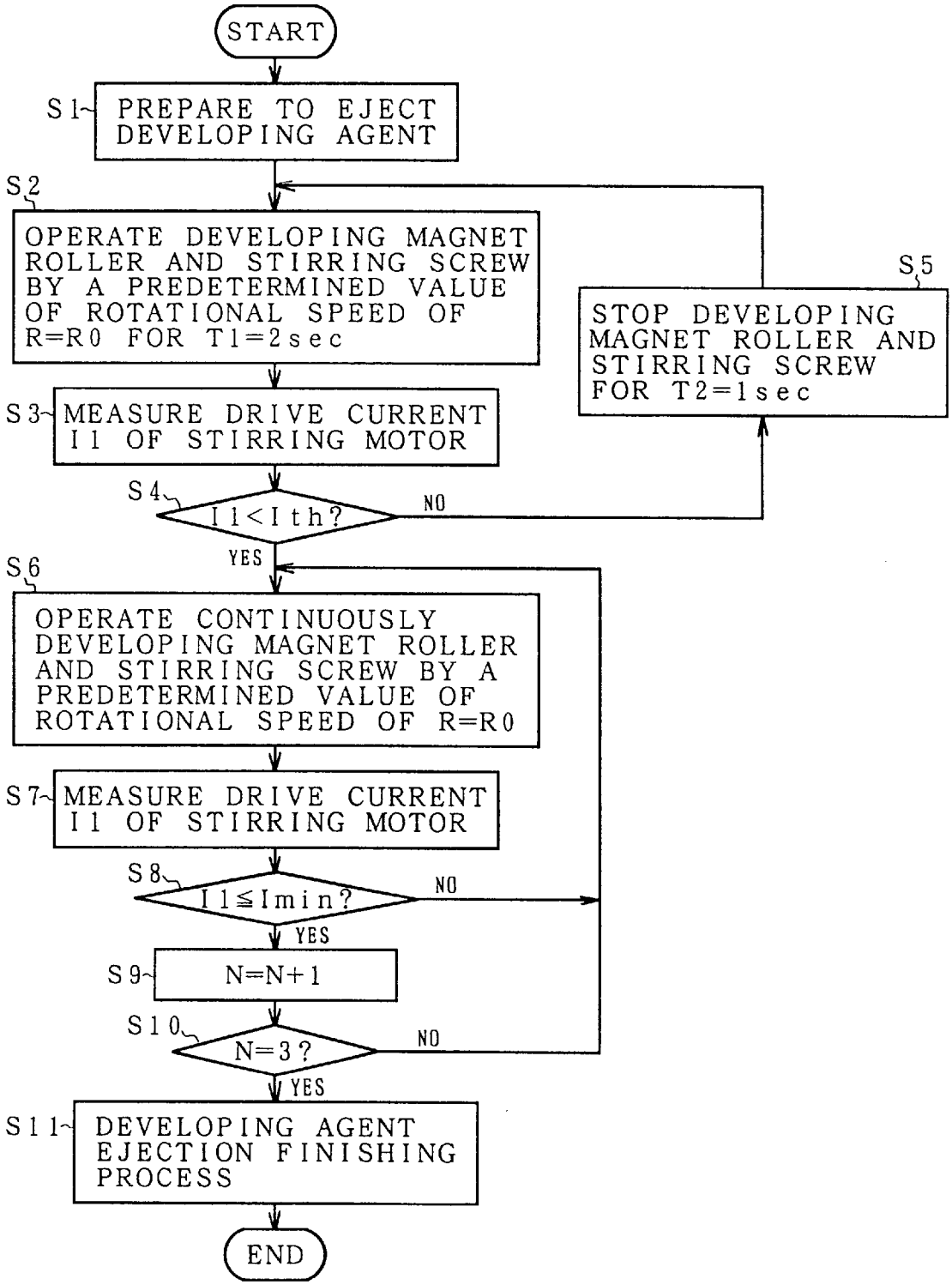
FIG. 7 is a flowchart for a control process of a developing agent ejection control unit in FIG. 6.
Figure 8:
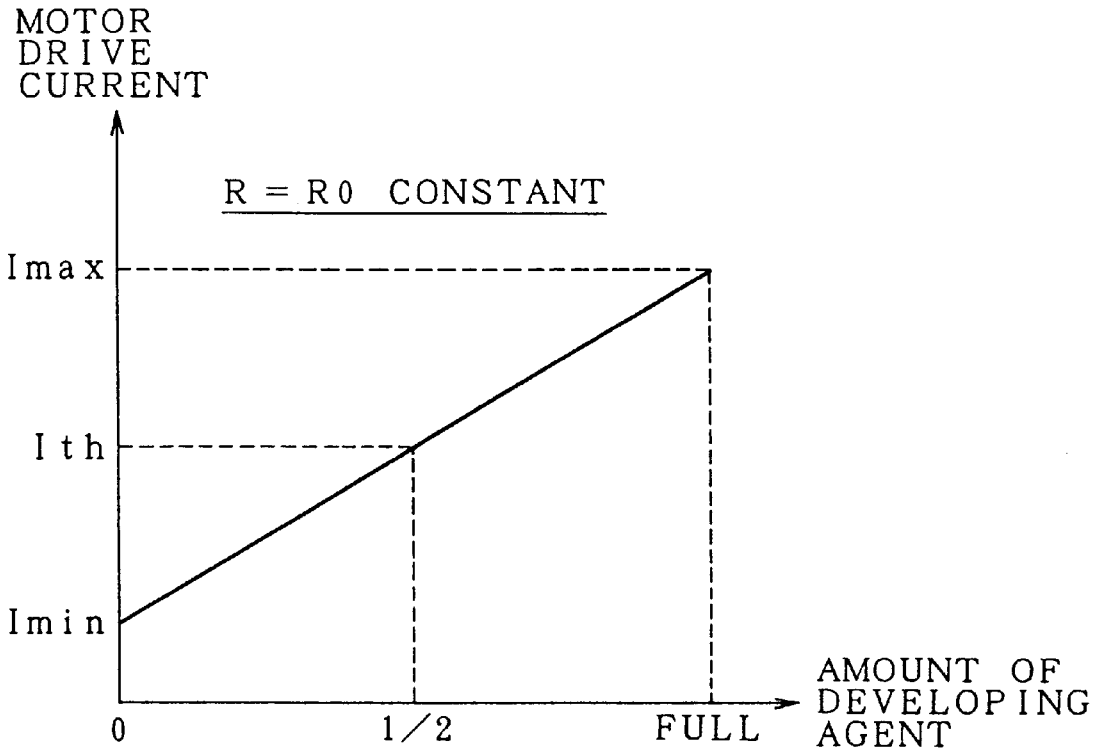
FIG. 8 is a characteristics diagram of a motor drive current for an amount of developing agent when a rotational speed of a stirring motor in FIG. 7 is set to be constant.

FIG. 8 is a characteristics diagram of a motor current consumption of the stirring motor 56 for the amount of developing agent in the developing device 22 in FIG. 7. The characteristics diagram shows a case where the stirring motor 56 is driven at the predetermined rotational speed R=R0. The developing agent amount before ejection of the developing agent is set to be full and a motor drive current in this instance is set to Imax. When the amount of developing agent decreases by the ejection of the developing agent, a motor load by the first and second stirring screws 46-1 and 46-2 is reduced and the motor drive current necessary to maintain the predetermined rotational speed R0 also consequently decreases. The characteristics diagram is expressed by a linear approximation in FIG. 8 in order to simply describe an environment in which the motor drive current decreases for the amount of developing agent. The amount of developing agent in the developing device 22 can be, therefore, estimated from the motor drive current. As a specified value Ith in step S4 in FIG. 7, for example, the motor drive current Ith when the amount of developing agent is reduced to the half in FIG. 8 is used. For a period of time during which the amount of developing agent is reduced from the full state to the half, the ejection control of the developing agent by the intermittent rotation of the developing magnet rollers 50-1 to 50-3 and first and second stirring screws 46-1 and 46-2 in steps S2 to S5 in FIG. 7 is executed. The control of the intermittent ejection in steps S2 to S5 corresponds to the control function that is executed by the intermittent ejection processing unit 106 provided in the developing agent ejection unit 104 in FIG. 6.

When the drive current I1 of the stirring motor 56 is below the specified value Ith in association with the ejection of the developing agent, the processing routine advances to step S6. The stirring motor 56 and developing motor 68 are continuously driven so as to continuously make the developing magnet rollers 50-1 to 50-3 and first and second stirring screws 46-1 and 46-2 operative at a predetermined value of the rotational speed of R=R0. Subsequently, the drive current I1 of the stirring motor 56 is measured in step S7 and is compared with a specified value Imin in step S8. As will be obviously understood from the characteristics diagram of FIG. 8, the specified value Imin is a motor drive current when the developing agent is completely ejected and the amount becomes zero, namely, what is called a no-load current of the stirring motor 56 when there is no developing agent. The continuous ejecting operation for continuously driving the developing magnet rollers 50-1 to 50-3 and first and second stirring screws 46-1 and 46-2 at the predetermined rotational speed R0 in steps S6 and S7 is repeated until the current consumption I1 of the stirring motor 56 is equal to or less than the specified value Imin in step S8. When the drive current I1 is equal to or less than the specified value Imin in step S8, step S9 follows and a count value of a counter N is increased by one. In step S10, a check is made to see whether the counter N has reached, for example, N=3. If N=3, it is determined that the developing agent has completely been ejected and a process for finishing the ejection of the developing agent is executed in step S11. That is, the code number or message indicative of the end of the developing agent ejection is outputted and displayed on the operation display panel. The hose 82 connected as shown in FIG. 2 is disconnected, the developing agent ejecting port 45 is closed, and the developing agent is newly supplied from a developing agent input port 86 provided in the upper portion of the developing device casing 42 shown in FIG. 3 into the developing device casing 42. In the processes in steps S9 and S10, it is determined for the first time that the ejection of the developing agent has completely been finished when the drive current I1 of the stirring motor 56 reaches the specified value Imin in the no-load state indicative of the ejection of the developing agent three times in a row. Consequently, a phenomenon such that in a state where there is a little amount of developing agent, the motor drive current I1 instantaneously decreases to Imin or less indicative of the no-load state, and the ejection end is determined.

Figure 9:
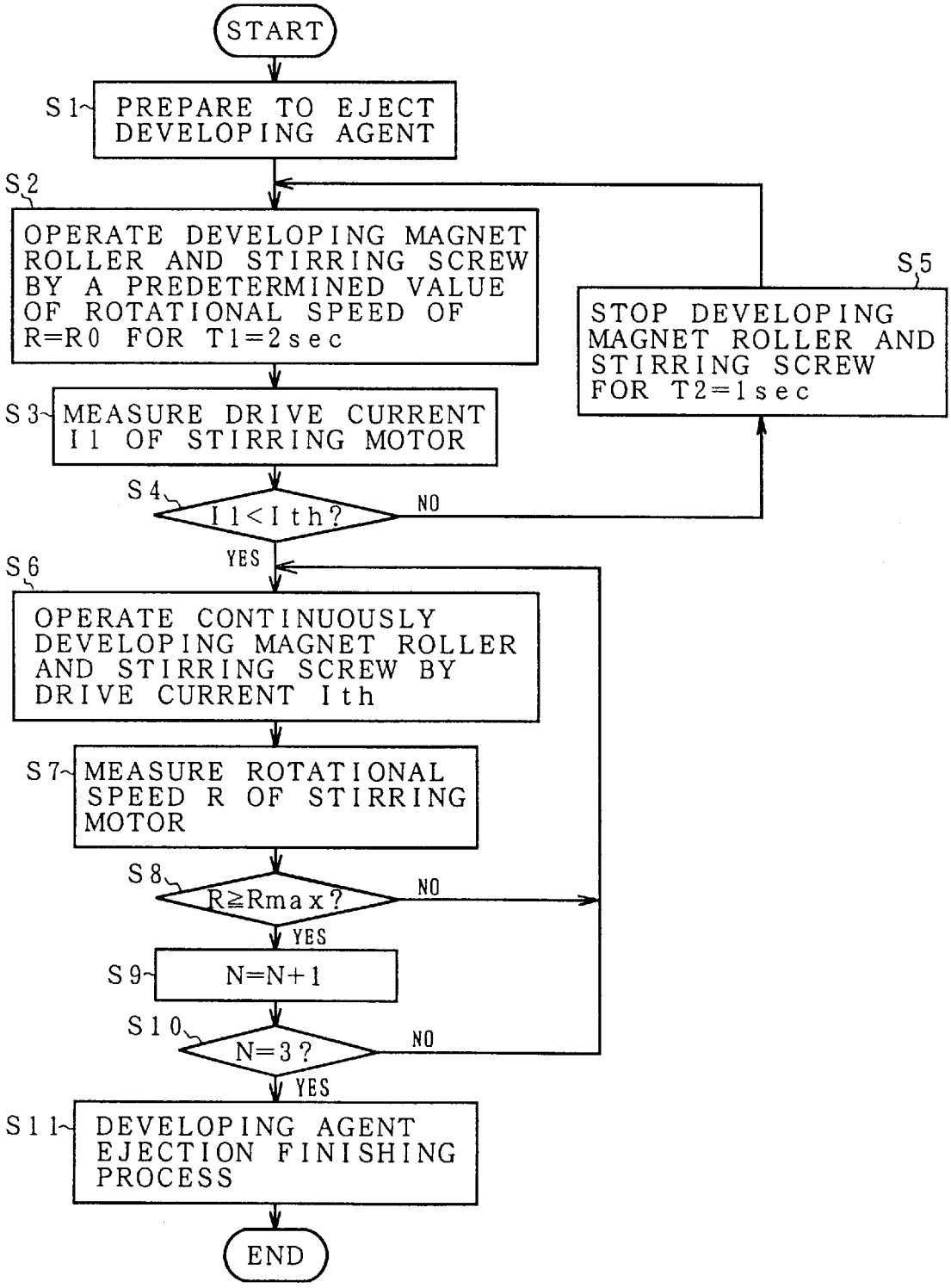
FIG. 9 is a flowchart for another control process of the developing agent ejection control unit in FIG. 6.

FIG. 9 is a flowchart for another control process of the developing agent ejection control in the electrophotographing apparatus of the invention. The ejection control process is characterized in that the completion of the ejection of the developing agent after the driving mode was switched from the intermittent ejection drive to the continuous ejection drive is discriminated from the rotational speed of the stirring motor. Processes in steps S1 to S5 are the same as those in the ejection controlling process of FIG. 7. As shown in the characteristics diagram of FIG. 8, for example, the intermittent ejection control in which the operation of the developing magnet rollers 50-1 to 50-3 and first and second stirring screws 46-1 and 46-2 at the predetermined rotational speed of R0 for T1=2 seconds and the stop for T2=1 second are repeated until the amount of developing agent decreases to the one-half, that is, the motor drive decreases to Ith. When the drive current I1 of the stirring motor 56 is below the specified value Ith in step S3 during the intermittent ejection, the processing routine advances to step S6. The stirring motor 56 and developing motor 68 are driven by the specified drive current Ith and the developing magnet rollers 50-1 to 50-3 and first and second stirring screws 46-1 and 46-2 are continuously operated. Subsequently, in step S7, the rotational speed of the stirring motor 56 is measured on the basis of a detection signal from the rotation detector 66. In step S8, a check is made to see if the rotational speed R is equal to or larger than a predetermined specified rotational speed Rmax. The specified rotational speed Rmax is determined in accordance with the characteristics of the motor rotational speed of the stirring motor 56 for the amount of developing agent in FIG. 10.

Figure 10:
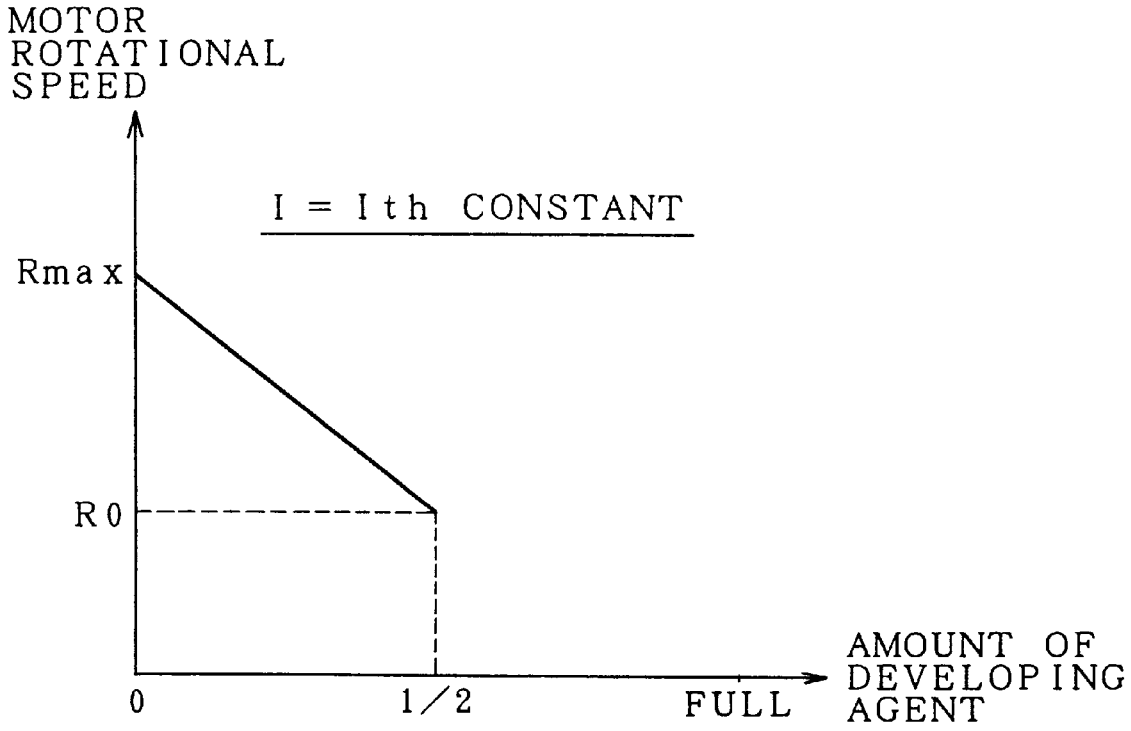
FIG. 10 is a characteristics diagram of a motor rotational speed for an amount of developing agent when the stirring motor is driven by a constant current in the control process of FIG. 9.

The characteristics diagram of FIG. 10 shows a change in the motor rotational speed R for the reduction in the amount of developing agent when the drive current I1 of the stirring motor 56 is fixed to I1=Ith. When the amount of developing agent decreases in a state where the motor drive current is set to the fixed value Ith, the motor rotational speed R increases by the reduction of the drive load. In this case, the relation of the motor rotational speed to the reduction in amount of the developing agent is treated on the assumption that it linearly increases for simplicity of explanation. Since the motor enters the no-load state when the amount of developing agent becomes zero, the motor rotational speed at this time becomes the maximum value Rmax. Therefore, in case of executing the continuous operation while setting the drive current of the stirring motor 56 to the fixed value Ith, whether the motor rotational speed reaches the maximum rotational speed Rmax in the no-load state corresponding to zero amount of the developing agent or not is discriminated, thereby enabling the completion of the ejection of the developing agent to be determined.

When the rotational speed R of the stirring motor 56 is equal to or less than the specified value Rmax in association with the reduction in amount of the developing agent in step S8, the processing routine advances to step S9 and the count value of the counter N is increased by one. The processes in steps S6 to S9 are repeated until the count value of the counter N is equal to, for example, N3 in step S10. After it was confirmed that the developing agent had completely been ejected, as a process for finishing the ejection of the developing agent, a code number or a message indicative of the end of the ejection is displayed in step S11.

Although the drive current of the stirring motor 56 is detected as shown in FIG. 6 and the developing agent ejection control of FIG. 7 is executed in the embodiment, the drive current of the developing motor 68 is detected and an ejection control can be also similarly executed. With respect to the embodiment for discriminating the completion of the ejection of the developing agent from the motor rotational speed in FIG. 9 as well, the above detection can be also realized by providing the rotation detector 66 for the developing motor 68.

Although the drive current of the stirring motor 56 is detected and the intermittent ejection control and the continuous ejection control are executed step by step in the embodiment of FIG. 6, by detecting the drive torque of the stirring motor 56 instead of the motor drive current, the ejection control can be similarly executed. This point can be also similarly applied to a case of detecting the drive torque of the developing motor 68.

Although the value when the amount of developing agent is reduced to ½ is used as a specified value Ith of the motor drive current for switching from the intermittent ejection control to the continuous ejection control in the characteristics diagram of FIG. 8, the invention is not limited to such an example. The motor drive current Ith corresponding to an optimum amount of the developing agent for switching from the intermittent ejection of the developing agent to the continuous ejection can be properly determined by experiments or the like. The specified value Imin corresponding to the no-load state which is used for discrimination about the end of the ejection of the developing agent in FIG. 8 and the maximum rotational speed Rmax in FIG. 10 can be also similarly experimentally determined.

Although the shift from the intermittent operation of the ejection control to the continuous operation is determined by the motor drive current in the foregoing embodiment, the intermittent operation can be also fixedly switched to the continuous operation by a time determined by experiments.

According to the invention as mentioned above, since the ejection situation of the developing agent is recognized from the actual driving state such as a current or torque of the motor which is driven when the developing agent is ejected and the operating state is switched from the intermittent operation to the continuous operation, the optimum switching timing adapted to the fluctuation factors such as amount of the developing agent which is actually ejected, toner concentration, lot difference, deterioration state according to the print conditions, apparatus environment such as a temperature or the like, and the like can be set. Since the end of the ejection of the developing agent is also discriminated by the drive current, drive torque, and further, rotational speed corresponding to the no-load state of the motor which is driven at the time of the ejection, a situation such that the developing agent is not completely ejected or contrarily, the operation is executed for a longer time than it is needed after completion of the ejection can be prevented. Thus, the complete ejection of the developing agent can be realized in a short time. According to the switching from the intermittent operation to the continuous operation by the predetermined time that was experimentally decided, it is not necessary to detect the motor current, torque, rotational speed, and the like and the ejection control of the developing agent can be easily certainly realized.

What is claimed is:

1. An electrophotographing apparatus comprising:

a developing device having a stirring member for stirring an enclosed developing agent, a developing agent conveying member for adsorbing said developing agent and developing an electrostatic latent image on a photosensitive material, and an ejecting port for ejecting said developing agent;

an intermittent ejection processing unit for detecting a driving state of at least one of driving motors of said developing agent conveying member and said stirring member which are driven at a predetermined rotational speed when said developing agent is ejected and intermittently making each of said driving motors operative until a detection value of said driving state reaches a specified value, thereby intermittently ejecting the developing agent; and a continuous ejection processing unit for continuously making each of said driving motors operative at a predetermined rotational speed after the detection value of said driving state reached the specified value, thereby continuously ejecting said developing agent.

2. An apparatus according to claim 1, wherein said continuous ejection processing unit finishes the ejection of the developing agent when the detection value of said driving state reaches a specified value corresponding to a no-load state by the completion of the ejection of said developing agent.

3. An apparatus according to claim 1, wherein each of said intermittent ejection processing unit and said continuous ejection processing unit detects a motor drive current as a driving state of said driving motor.

4. An apparatus according to claim 1, wherein each of said intermittent ejection processing unit and said continuous ejection processing unit detects a motor drive torque as a driving state of said driving motor.

5. A developing agent ejecting method of an electrophotographing apparatus having a developing device including a stirring member for stirring an enclosed developing agent, a developing agent conveying member for adsorbing said developing agent and developing an electrostatic latent image on a photosensitive material, and an ejecting port for ejecting said developing agent, comprising:

an intermittent ejecting step of detecting a driving state of at least one of driving motors of said developing agent conveying member and said stirring member which are driven at a predetermined rotational speed when said developing agent is ejected and intermittently making each of said driving motors operative until a detection value of said driving state reaches a specified value, thereby intermittently ejecting the developing agent;

a continuous ejecting step of continuously making each of said driving motors operative at a predetermined rotational speed after the detection value of said driving state reached the specified value, thereby continuously ejecting said developing agent; and an ejection finishing step of finishing the ejection of the developing agent when the detection value of said driving state reaches a specified value corresponding to a no-load state by the completion of the ejection of said developing agent in said continuous ejecting step.

6. An electrophotographing apparatus comprising:

a developing device having a stirring member for stirring an enclosed developing agent, a developing agent conveying member for adsorbing said developing agent and developing an electrostatic latent image on a photosensitive material, and an ejecting port for ejecting said developing agent;

an intermittent ejection processing unit for detecting a driving state of at least one of driving motors of said developing agent conveying member and said stirring member which are driven at a predetermined rotational speed when said developing agent is ejected and intermittently making each of said driving motors operative until a detection value of said driving state reaches a specified value, thereby intermittently ejecting the developing agent; and a continuous ejection processing unit for continuously ejecting said developing agent by a continuous operation in which a drive current of each of said driving motors is fixed to a predetermined value after the detection value of said driving state reached the specified value.

7. An apparatus according to claim 6, wherein said continuous ejection processing unit detects a rotational speed of the driving motor during the continuous ejection after the detection value of said driving state reached the specified value and finishes the ejection of the developing agent when the rotational speed of said driving motor increases to a specified rotational speed corresponding to a no-load state by the completion of the ejection of said developing agent.

8. An apparatus according to claim 6, wherein said intermittent ejection processing unit detects a motor drive current as a driving state of said driving motor.

9. An apparatus according to claim 6, wherein said intermittent ejection processing unit detects a motor drive torque as a driving state of said driving motor.

10. A developing agent ejecting method of an electrophotographing apparatus having a developing device including a stirring member for stirring an enclosed developing agent, a developing agent conveying member for adsorbing said developing agent and developing an electrostatic latent image on a photosensitive material, and an ejecting port for ejecting said developing agent, comprising:

an intermittent ejecting step of detecting a driving state of at least one of driving motors of said developing agent conveying member and said stirring member which are driven at a predetermined rotational speed when said developing agent is ejected and intermittently making each of said driving motors operative until a detection value of said driving state reaches a specified value, thereby intermittently ejecting the developing agent;

a continuous ejecting step of continuously ejecting said developing agent by a continuous operation in which a drive current of each of said driving motors is fixed to a predetermined value after the detection value of said driving state reached the specified value; and an ejection finishing step of finishing the ejection of the developing agent when a rotational speed of said driving motor increases to a specified rotational speed corresponding to a no-load state by the completion of the ejection of said developing agent in said continuous ejecting step.

* * * * *